US007530829B2

(12) United States Patent
Yuan et al.

(10) Patent No.: US 7,530,829 B2
(45) Date of Patent: May 12, 2009

(54) SOCKET CONNECTOR

(75) Inventors: Wei Yuan, ShenZhen (CN); Yu-San Hsiao, Tu-Cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/002,748

(22) Filed: Dec. 18, 2007

(65) Prior Publication Data

US 2008/0146086 A1 Jun. 19, 2008

(51) Int. Cl.
*H01R 33/02* (2006.01)

(52) U.S. Cl. ..... 439/232

(58) Field of Classification Search ..... 439/723, 439/239, 698, 232, 263, 259–260, 236, 230, 439/271, 242, 280, 617, 682, 238, 226, 365, 439/356, 233–234; 349/58, 61; 362/217, 362/376, 396, 269, 226, 448, 441
See application file for complete search history.

(56) References Cited

U.S. PATENT DOCUMENTS 5,886,758 A * 3/1999 Ibaraki ..... 349/58
7,344,397 B2 * 3/2008 Miyazono ..... 439/232

* cited by examiner

*Primary Examiner*—Edwin A. Leon
(74) *Attorney, Agent, or Firm*—Wei Te Chung

(57) ABSTRACT

A socket connector comprises a dielectric housing, a conductive contact, and a pickup. The dielectric housing comprising a first sidewall, a opposed second sidewall, and an endwall which connecting said first and second sidewalls and further defines an opening therein; Said conductive contact received in said dielectric housing and having a pair of resilient contacting sections extending between said sidewalls; Said lock-up releasably secured in said opening of said dielectric housing and compressing said pair of contacting sections of conductive contact toward each other. When dismount the backlight, the operator can see the conductive portion of the backlight and the contacting section of the conductive contact, and there is a large operating space for conveniently mounting and dismounting the lock-up.

14 Claims, 3 Drawing Sheets

2

SOCKET CONNECTOR

BACKGROUND OF THE INVENTION

1. Field of the Invention

The present invention relates to a socket connector, especially to a socket connector for electrical connecting an LCD (Liquid Crystal Display) backlight to a circuit board.

2. Description of Related Art

In the prior art, there is known a LCD with backlight. The LCD has a circuit board onto which socket connectors are mounted and electrically connected. The backlight is received by the sockets and is thereby electrically connected to a backlight power source in the LCD. The backlight is referred to as a LCD backlight. The circuit board is referred to as a LCD circuit board. The socket connectors are referred to as LCD socket connectors.

The related art can refer to the Chinese Patent issue No. CN1101554C issued on Feb. 12, 2003.

Referring to FIG. 1, a LCD socket connector 1 for electrically connecting an LCD backlight 2 to a LCD circuit board 3, comprises a dielectric housing 12, a conductive contact 13 received in the dielectric housing 12, and a lock-up 11 secured on the dielectric housing 12. The dielectric housing 12 comprises a bottom portion 120, a first sidewall 121 and an opposed second sidewall 122 extending from the bottom portion 120. There is a recess 126 in first and second sidewalls 121, 122 respectively. The lock-up 11 comprises a base portion 110 and a first and a second arm 111, 112 extending from the base portion 110 toward the same direction. There is a first barb 114 on the outer side of the first arm 111 corresponding to the position of the recess 126 in the first sidewall 121 and there is a second barb 115 on the outer side of the second arm 112 corresponding to the position of the recess 126 in the second side wall 122.

The conductive contact 13 comprises body section 131, a pair of symmetrical contacting sections 132 extending from two opposed sides of the body section 131, and a solder section 1321 extending from the body section 131 for electrically connecting to the conductive section (not shown) of the LCD circuit board 3. The conductive contact 13 is secured on the bottom portion 120 of the dielectric housing 12 with the pair of contacting sections 132 located between the first and second sidewalls 121, 122.

When mounting the backlight 2 to the socket connector 1, the conductive portion 20 of the backlight 2 is inserted into the place between the pair of contacting section 132. The lock-up 11 is insert into the place between the first and second sidewalls 121, 122. The barbs 114, 115 on the first and second arms 111, 112 are secured in the recess 126 of the first and second sidewall 121, 122. At the same time, the first and second arms 111, 112 compress the pair of contacting sections 132 of conductive contact 13 toward each other, so the contacting sections 132 is tightly holding the conductive portion 20 of the backlight 2.

The lock-up 11 must be drawn out from the dielectric housing 12 and open the contacting section 132 of the conductive contact 13 before the backlight 2 is dismounted. During the operation, the lock-up 11 blocks the operator's sight, the operator must rely on the sense of hand to judge the position, so the operation is not simple enough.

Hence, an improved connector assembly is required to overcome the disadvantages of the prior art.

SUMMARY OF THE INVENTION

An object of the present invention is to provide a socket connector with a lock-up which is easy to mount and dismount LCD backlight.

A socket connector, comprises a dielectric housing, a conductive contact, and a pickup. The dielectric housing comprising a first sidewall, a opposed second sidewall, and an endwall connecting said first and second sidewalls and defining an opening therein; Said conductive contact received in said dielectric housing and having a pair of resilient contacting sections extending between said sidewalls; Said lock-up releasably secured in said opening of said dielectric housing and compressing said pair of contacting sections of conductive contact toward each other.

According to the present invention, when dismount the backlight, the operator can see the conductive portion of the backlight and the contacting section of the conductive contact, and there is a large operating space for conveniently mounting and dismounting the lock-up.

Other objects, advantages and novel features of the present invention will become more apparent from the following detailed description of the present embodiment when taken in conjunction with the accompanying drawings.

DETAILED DESCRIPTION OF THE INVENTION

Reference will now be made in detail to the preferred embodiment of the present invention.

Figure 1:
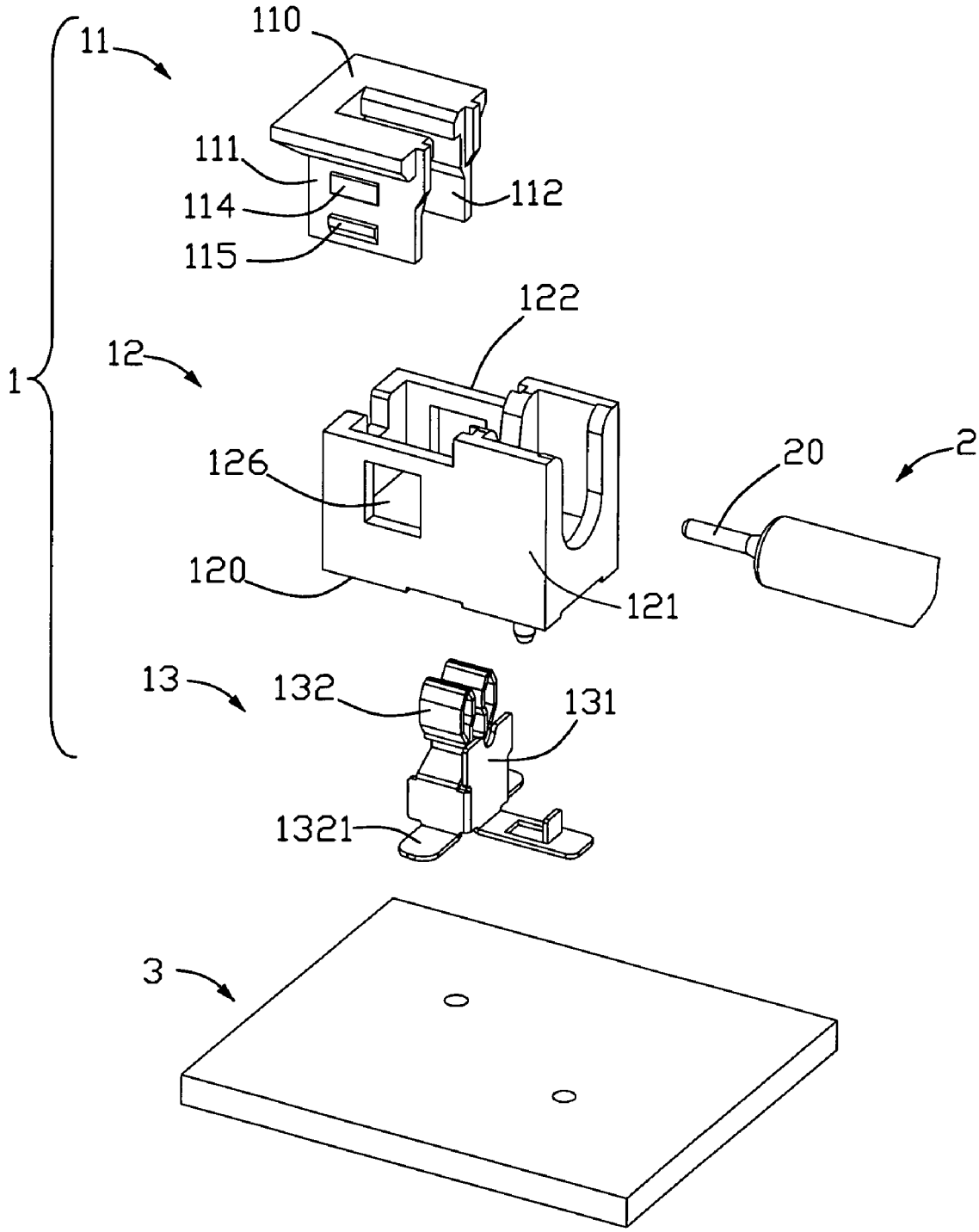
FIG. 1 (PRIOR ART)
FIG. 1 is an exploded, perspective view of an LCD socket connector of the related art, the LCD circuit board and LCD backlight are shown, too.
Figure 2:
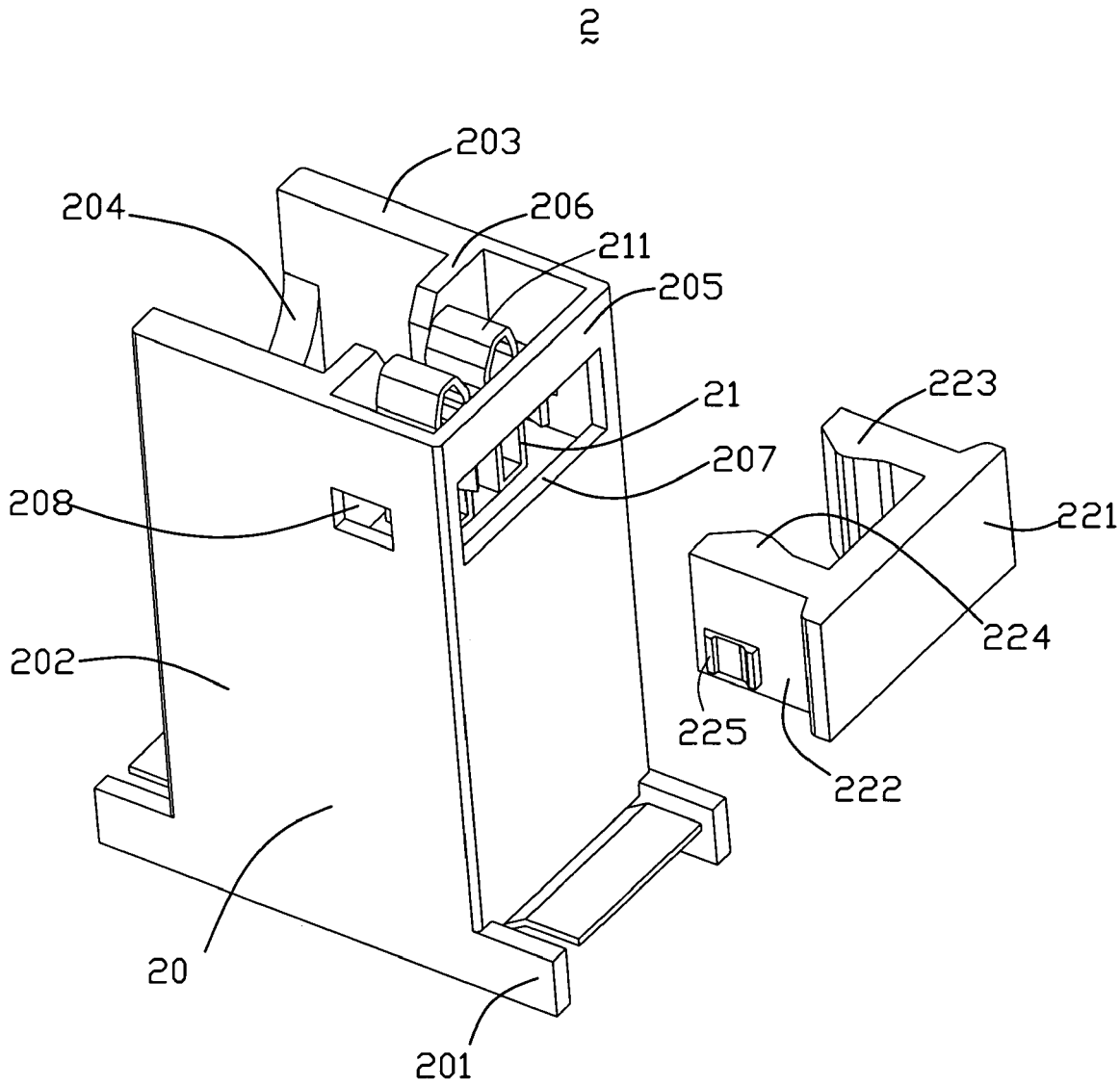
FIG. 2 is a perspective view of a socket connector of the present invention, wherein a lock-up thereof is separated from a dielectric housing thereof.
Figure 3:
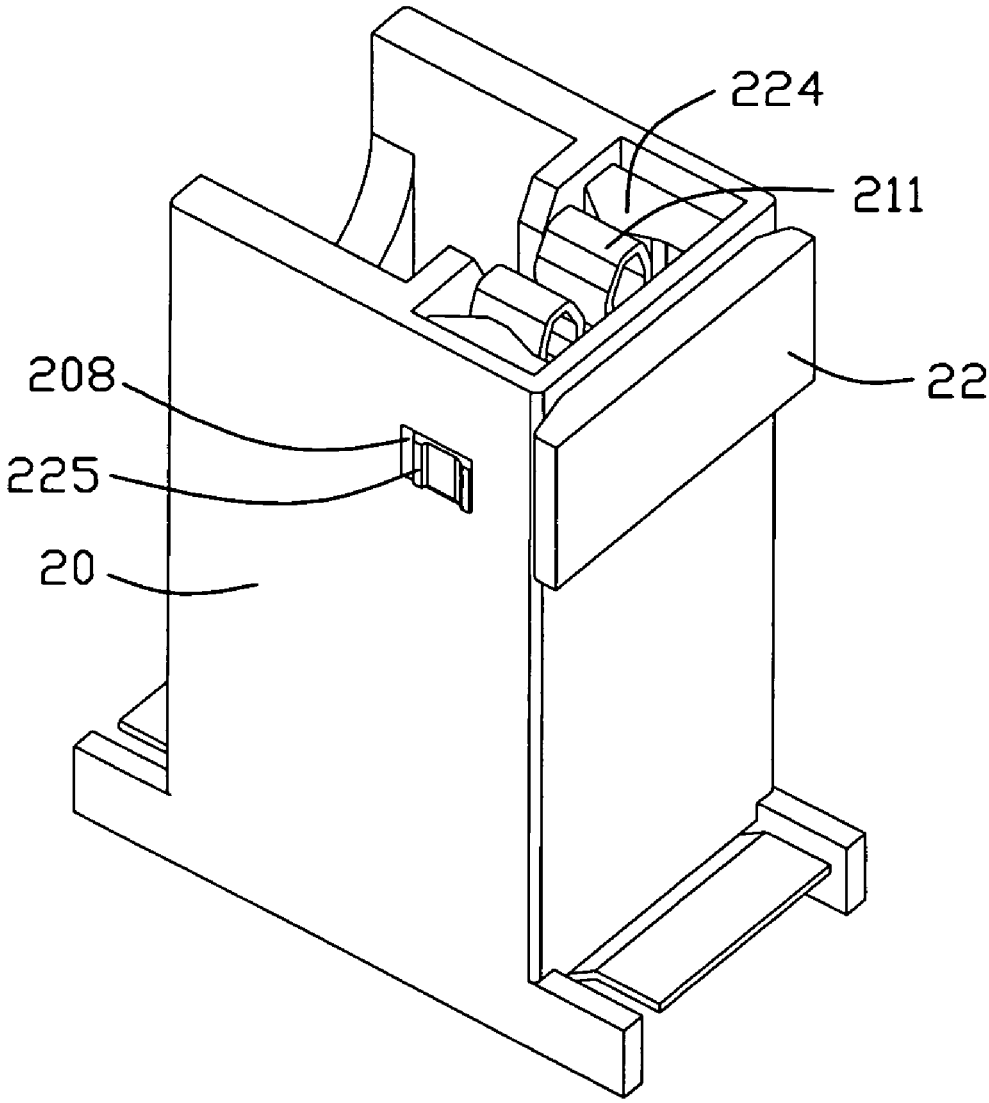
FIG. 3 is an assembled, perspective view of the socket connector of the present invention.

Referring to FIGS. 2-3, a socket connector 2 for electrical connecting an LCD backlight (not shown) to a circuit board (not shown), comprises a dielectric housing 20, a conductive contact 21 retained in the dielectric housing 20, and a pickup 22 secured on the dielectric housing 20.

The dielectric housing 20 has a base 201, a plurality of sidewalls extending upwardly from base 201 and defines mating cavity (not labeled) therebetween. The sidewalls comprise a first sidewall 202, an opposed second sidewall 203, and a front and a back endwalls 204, 205 which connecting said first and second sidewalls 202, 203, so said mating cavity defining a mating face on top side. Further, there is intermediate wall 206 in the receiving room. Wherein, each of said first and second sidewalls 202, 203 defines a recess 208; the front endwall 204 and the intermediate wall 206 each has a cutout (not labeled), the back endwall 205 defines an opening 207 therein. Wherein, the cutout in the front endwall 204 is larger than the cutout in the intermediate wall 206 for receiving the different sections of the mounting portion of the backlight.

Said conductive contact 21 having a pair of resilient contacting sections 211. Said conductive contact 21 retained in said dielectric housing 20, said pair of resilient contacting sections 211 extending between said sidewalls 202, 203 and disposed in the location corresponding to the opening 208.

Said lock-up 22 having a planar surface and a pair of opposed first and second arms 222, 223 extending from another side of the base portion 221 opposed to the planar surface. Wherein, each of said first and second arms 222, 223 has a projection 224 on the inner side, and defines a barb 225 on the outer side 208. Said lock-up 22 is releasably secured in said opening 207 of said dielectric housing 20 and has a base portion 221. The projections 224 can compress said pair of contacting sections 211 of conductive contact 21 toward each other. The barb 225 can be releasably locked in said recess 208 in the first and second sidewalls 202, 203.

After the socket connector 2 is mounted on the circuit board, the backlight can be mounted to the socket connector 2.

Before mounting the backlight, the lock-up 22 is got off from the dielectric housing 20. Let the conductive portion of backlight insert into the space between the pair of contacting section 211 of the conductive contact 21, a thin section of the mounting portion of the backlight receiving in the cutout in the intermediate wall, a fat section of the mounting portion of the backlight receiving in the cutout in the front endwall. Then secure the lock-up 22 onto the dielectric housing 20, the first and second arms 222, 223 insert through the opening 207 in the back endwall 205 from the back direction, barbs 225 on the first and second arms 222, 223 is received and locked in the recess 208 in the first and second sidewalls 202, 203. At the same time, the projection 224 on the arms 222, 223 compress the contacting section 211, the contacting section 211 is compressed toward each other and tightly holds the conductive portion of the backlight.

According to the preferred embodiment in accordance with the present invention has been shown and described, the contacting status between the conductive portion of the backlight and the conductive contact can be clearly seen; when dismount the backlight, the operator can see the contacting point between the conductive portion of the backlight and the contacting section 211 of the conductive contact 21; further more, there is a large operating space for conveniently mounting and dismounting the lock-up 22.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A socket connector, comprising:

a dielectric housing comprising a first sidewall, an opposed second sidewall, and an endwall, said endwall connecting said first and second sidewalls and further defining an opening therein;

a conductive contact received in said dielectric housing and having a pair of resilient contacting sections extending along a first direction between said first and second sidewalls, said pair of contacting sections can move along a second direction perpendicular to said first direction; and a lock-up releasably secured in said opening of said dielectric housing along a third direction perpendicular to said first direction and perpendicular to said second direction and compressing said pair of contacting sections of conductive contact toward each other.

2. The socket connector as described in claim 1, wherein said lock-up has a base portion having a planar surface and a pair of opposed first and second arms extending from another side of the base portion opposed to the planar surface.

3. The socket connector as described in claim 2, wherein each of said first and second arms has a projection on the inner side, said projections compress said pair of contacting sections of conductive contact toward each other.

4. The socket connector as described in claim 3, wherein each of said first and second sidewalls defines a recess and each of said first and second arms defines a barb be releasably lacked in said recess.

5. A socket connector, comprising:

a dielectric housing comprising a mating cavity defining a mating aperture on a horizontal top side thereof and defining an endwall on a vertical back side thereof, said endwall having an opening therein;

a conductive contact retained in said dielectric housing and having a pair of resilient contacting sections extending upwardly in the mating cavity and disposed in a location corresponding to said opening in the endwall; and a lock-up releasably secured on said dielectric housing by inserting through said opening in the endwall and compressing said pair of contacting sections of conductive contact toward each other.

6. The socket connector as described in claim 5, wherein said lock-up has a base portion having a planar surface and a pair of opposed arms extending from another side of the base portion opposed to the planar surface.

7. The socket connector as described in claim 6, wherein each of said arms has a projection on the inner side, said projections compress said pair of contacting sections of conductive contact toward each other.

8. The socket connector as described in claim 7, wherein said dielectric housing further comprising a pair of opposed sidewalls defining a recess therein and each of said arms defining a barb releasably locked in said recess.

9. A socket connector, comprising:

an insulative housing defining juxtaposed first and second cavities;

a contact located in the first cavity;

the second cavity configured to be adapted to receive a tubular backlight under a condition that a conductor of said backlight enters the first cavity and mechanically and electrically connected to the contact;

a lock-up transversely, alone a horizontal direction, assembled to the housing and locking the contact to assure engagement between the contact and the conductor of the backlight under a condition tat engagement between the conductor and the contact can be fully investigated in a top view in a vertical direction perpendicular to said horizontal direction.

10. The socket connector as described in claim 9, wherein said contact defines a pair of clamps adapted to sandwich the conductor of said backlight.

11. The socket connector as described in claim 10, wherein top portions of said pair of clamps are fully upwardly exposed to an exterior.

12. The socket connector as described in claim 10, wherein said lock-up defines a pair of arms sandwiching said pair of clamps therebetween.

13. The socket connector as described in claim 12, wherein pair of arms are connected by a complete plate which fully transversely covers the pair of clamps without exposure.

14. The socket connector as described in claim 12, wherein a vertical wall of the housing which surrounds the first cavity, defines an opening which is large enough to allow said pair of arms of the lock-up to extend therethrough.

* * * * *